US012677875B2

(12) United States Patent
Sanders

(10) Patent No.: US 12,677,875 B2
(45) Date of Patent: Jul. 14, 2026

(54) VAPORIZING DEVICE WITH RESIDUE RESERVOIR

(71) Applicant: Anarking LLC, Malibu, CA (US)

(72) Inventor: Jon Barton Sanders, Malibu, CA (US)

(73) Assignee: Anarking LLC, Malibu, CA (US)

( * ) Notice: Subject to any disclaimer, the term of this patent is extended or adjusted under 35 U.S.C. 154(b) by 728 days.

(21) Appl. No.: 17/724,397

(22) Filed: Apr. 19, 2022

(65) Prior Publication Data

US 2023/0329338 A1 Oct. 19, 2023

(51) Int. Cl.

| | |
|---|---|
| ***A24F 40/42*** | (2020.01) |
| ***A24F 1/30*** | (2006.01) |
| ***A24F 5/00*** | (2006.01) |
| ***A24F 7/00*** | (2006.01) |
| ***A24F 40/48*** | (2020.01) |

(52) U.S. Cl.

CPC ..... *A24F 40/42* (2020.01); *A24F 1/30* (2013.01); *A24F 5/00* (2013.01); *A24F 7/00* (2013.01); *A24F 40/48* (2020.01)

(58) Field of Classification Search

None

See application file for complete search history.

(56) References Cited

U.S. PATENT DOCUMENTS

| | | | | |
|---|---|---|---|---|
| 3,881,499 | A * | 5/1975 | McFadden | A24F 1/30 131/222 |
| 4,029,109 | A * | 6/1977 | Kahler | A24F 1/30 131/195 |
| 8,983,282 | B2 * | 3/2015 | Bishara | A24F 1/30 131/173 |
| 10,517,334 | B1 * | 12/2019 | Volodarsky | A24F 1/30 |
| 2010/0126516 | A1 * | 5/2010 | Yomtov | A24F 1/30 29/401.1 |
| 2017/0055579 | A1 * | 3/2017 | Kuna | A24F 1/00 |

* cited by examiner

*Primary Examiner* — Philip Y Louie
*Assistant Examiner* — Jeffrey A. Buckman
(74) *Attorney, Agent, or Firm* — Lynch LLP; Sean Lynch

(57) ABSTRACT

Systems and methods of the inventive subject matter are directed to vaporization devices having components that are designed to receive residue buildup. Embodiments include a bowl portion having a removable bowl with a heating element as well as a residue reservoir, a recycler portion having a first chamber and a second chamber, where the second chamber has a stem and mouthpiece, as well as a main housing for electronics, batteries, inputs, and the like. When a user inhales through the mouthpiece, the heating element is activated to vaporize the contents of the bowl, and an air/vapor mixture then travels through the bowl portion where it deposits residue in the residue reservoir before traveling into the recycler portion before being inhaled by the user via the mouthpiece. The residue reservoir is positioned at a lowest point along an air/vapor mixture pathway, further allowing for residue accumulation by gravitational forces.

11 Claims, 3 Drawing Sheets

VAPORIZING DEVICE WITH RESIDUE RESERVOIR

FIELD OF THE INVENTION

The field of the invention is vaporizing systems featuring a residue reservoir.

BACKGROUND

The background description includes information that may be useful in understanding the present invention. It is not an admission that any of the information provided in this application is prior art or relevant to the presently claimed invention, or that any publication specifically or implicitly referenced is prior art.

Vaporization of cannabis and tobacco products is a popular alternative to smoking. It requires lower temperatures and generally avoids inhaling gases that result from burning. A variety of different products can be vaporized, including liquids, crystalline solids, plant matter, oils, and so on. An issue that consistently arises with vaporization is the creating of sticky residues that can accumulate in a vaporization device. When enough sticky residue accumulates, it can interfere with proper function of the device by, e.g., creating blockages that stop gas flow through those devices entirely.

While innovation in the vaporization space has occurred to improve a variety of different features, it has yet to be appreciated that vaporization devices can be used for longer and used more reliably if they are designed to minimize residue interference. In general vaporization innovation focuses on improving temperature controls and vaporization methodology to enhance user experience, but these efforts do not consider improvements that can result from reducing downtime by creating a system that needs to be cleaned less often and minimizes the impact of residue buildup over time.

Thus, there is still a need in the art for vaporization devices that feature systems designed to reduce residue buildup in critical components by creating a space for residue to accumulate where it can be easily cleaned up and disposed of or repurposed to reduce waste.

SUMMARY OF THE INVENTION

The present invention provides apparatuses, systems, and methods directed to vaporizers that include residue reservoirs to improve performance. In one aspect of the inventive subject matter, a vaporizing device comprises: a bowl portion with a removable bowl inside, where the removable bowl comprises a heating element coupled to a bottom portion; a gas flow pathway connecting the bowl portion to a residue reservoir, where the residue reservoir connects to a vapor recycler portion having a first chamber and a second chamber. The first chamber has a bottom reservoir, a vertical gas pathway, and an annular gas pathway surrounding the vertical gas pathway, and the second chamber connects to the first chamber by a top gas pathway and a bottom gas pathway. A stem includes a mouthpiece hole and extends from the second chamber, and when a user inhales via the mouthpiece hole, the heating element is activated and gas travels through an air/vapor mixture pathway that includes the gas flow pathway, the residue reservoir, the bottom reservoir, the vertical gas pathway, the annular gas pathway, at least one of the top gas pathway and the bottom gas pathway, the second chamber, and the stem. The residue reservoir is positioned at a lowest point along the air/vapor mixture pathway.

In some embodiments, the vaporizing device also includes a removable carb configured to couple with the bowl portion. The heating element can be configured to heat the removable bowl to between 126° F. to 650° F. In some embodiments, the vaporizing device also includes a housing portion that has an interior space for batteries and an exterior surface with a display, a charging port, and at least one input.

In another aspect of the inventive subject matter, a vaporizing device includes: a bowl portion having a bowl with a heating element coupled to it; a gas flow pathway connecting the bowl portion to a residue reservoir, where the residue reservoir is further coupled with a vapor recycler portion comprising a first chamber and a second chamber. The second chamber couples with the first chamber by a top gas pathway and a bottom gas pathway, and a mouthpiece extends from the second chamber. When a user inhales via the mouthpiece, the heating element is activated and gas travels through an air/vapor mixture pathway that includes the gas flow pathway, the residue reservoir, the first chamber, at least one of the top gas pathway and the bottom gas pathway, the second chamber, and the mouthpiece. The residue reservoir is positioned at a lowest point along the air/vapor mixture pathway to improve its performance.

In some embodiments, the first chamber includes a bottom reservoir, a vertical gas pathway, and an annular gas pathway surrounding the vertical gas pathway. The first chamber and the second chamber can be configured to hold water, and the device can additionally include a removable carb configured to couple with the bowl portion. In some embodiments, the heating element is configured to heat the bowl to between 126° F. to 650° F.

One should appreciate that the disclosed subject matter provides many advantageous technical effects including creating a space for residue from vaporized matter to accumulate. This helps to prevent clogging while also making cleaning easier.

Various objects, features, aspects, and advantages of the inventive subject matter will become more apparent from the following detailed description of preferred embodiments, along with the accompanying drawing figures in which like numerals represent like components.

DETAILED DESCRIPTION

Figure 1:
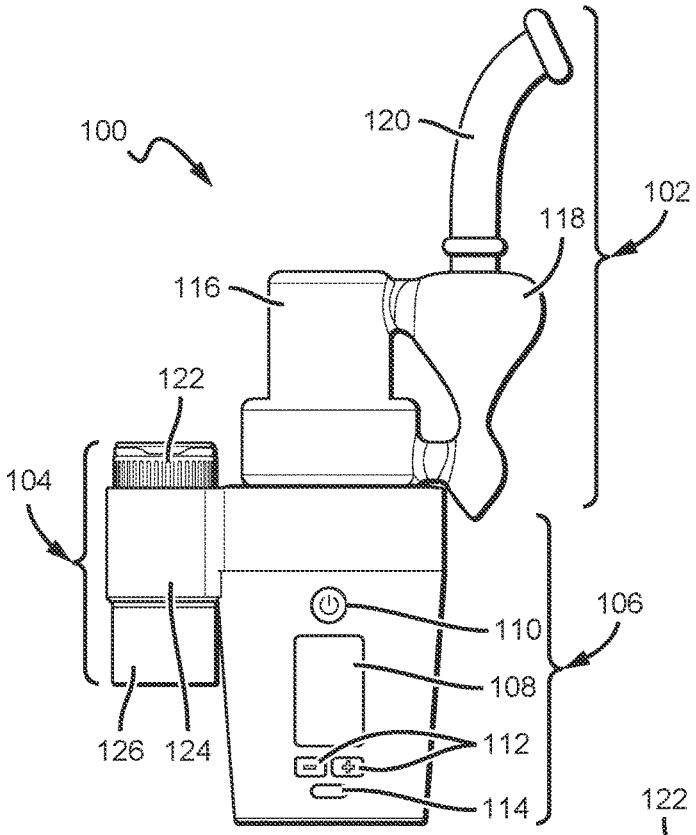
FIG. 1 shows a vaporization device from the side.

The following discussion provides example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used in the description in this application and throughout the claims that follow, the meaning of "a," "an," and "the" includes plural reference unless the context clearly dictates otherwise. Also, as used in the description in this application, the meaning of "in" includes "in" and "on" unless the context clearly dictates otherwise.

Also, as used in this application, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing numbers or number ranges used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth in this application should be interpreted as being inclusive of their endpoints and open-ended ranges should be interpreted to include only commercially practical values. Similarly, all lists of values should be considered as inclusive of intermediate values unless the context indicates the contrary.

Embodiments of the inventive subject matter are directed to a device configured to vaporize, e.g., cannabis, cannabis products (e.g., wax, oil, batter, shatter, rosin, etc.), tobacco, tobacco products and byproducts, nicotine products (e.g., e-liquids), tinctures. A key difference between the inventive subject matter and existing products in this space is the presence of a reservoir designed to accumulate residues that can accumulate through normal use. This feature, along with the device's configuration that is designed to make use of this feature, helps to prevent clogging of smaller pathways in devices of these types that are commonly blocked by residues. Although this application primarily describes vaporization, devices in this space can and often do burn matter in addition to, or instead of, vaporizing it. Burning does not deviate from the inventive subject matter, and in all instances where vaporization is disclosed, it should be understood that this can mean vaporizing, burning and vaporizing, or simply burning matter for inhalation.

Vaporizing device 100 is shown from a side view in FIG. 1. Several key components can be seen, including vapor mixture recycler portion 102, bowl portion 104, and main housing portion 106. Each portion includes multiple features. For example, the main housing portion 106 comprises a display 108, a power button 110, two input buttons 112, and an I/O port 114 that can also be used to charge the device. In some embodiments I/O port is a serial port, such as a micro-USB or USB-A port. Power button 110 can be used to turn the device on and off, though it can also be used as a toggle for different functions such as a sleep mode, to access device settings, or to change the device's mode. Input buttons 112 can be used to, e.g., adjust vaporization temperature or to cycle through various other functions of the device. Display 108 can show a user the device's current settings, e.g., to facilitate changing those settings using one or more of power button 110 and the input buttons 112. Finally, main housing portion 106 houses batteries and electronics associated with device 100.

Vapor mixture recycler portion 102 features a first chamber 116 and a second chamber 118 as well as a stem 120. When in use, device 100 creates a combination of air and a vaporized substance that passes through first chamber 116, second chamber 118, and then stem 120 where a user places their lips to inhale. Bowl portion 104 features a removable carb 122, a bowl chamber 124, and a residue reservoir 126.

Figure 2:
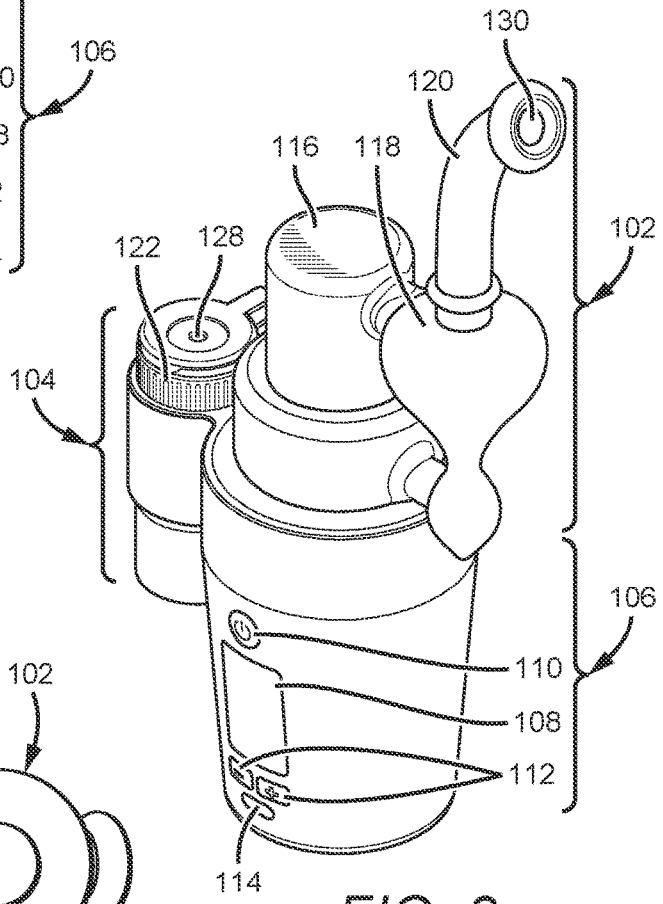
FIG. 2 shows the vaporization device from an isometric view.
Figure 3:
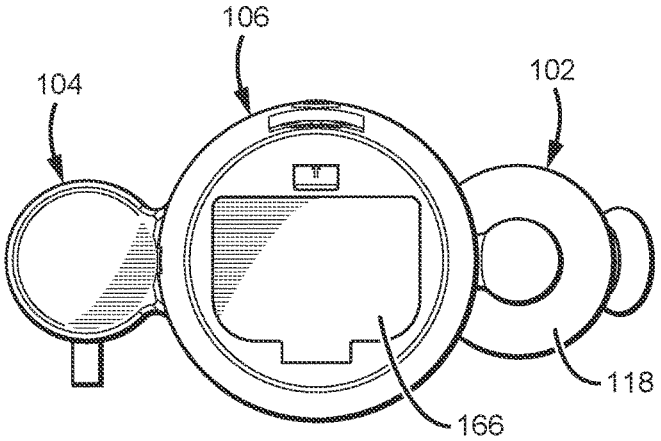
FIG. 3 shows the vaporization device from the bottom.
Figure 4:
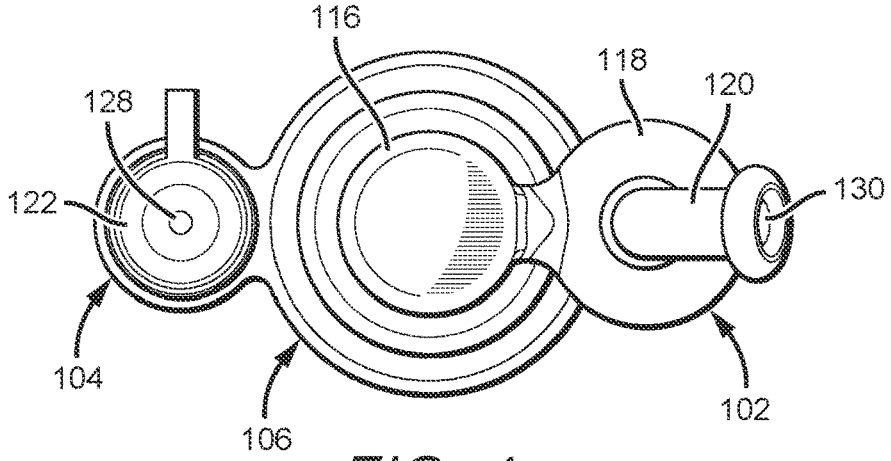
FIG. 4 shows the vaporization device from the top.

FIG. 2 shows an isometric view of device 100. This view makes visible the different shapes of, e.g., vapor mixture recycler portion 102, bowl portion 104, and main housing portion 106. For example, second chamber 118 is formed primarily of two bulbous portions with stem 120 emerging therefrom. This view also makes inlet 128 visible on removable carb 122 as well as mouthpiece hole 130. FIG. 3 shows a bottom view of device 100. A bottom surface of main housing portion 106 comprises battery port 166. FIG. 4 shows a top view of device 100, which shows inlet 128 of removable carb 122, as well as first chamber 116, second chamber 118, stem 120 120, and mouthpiece hole 130, etc.

Figure 5:
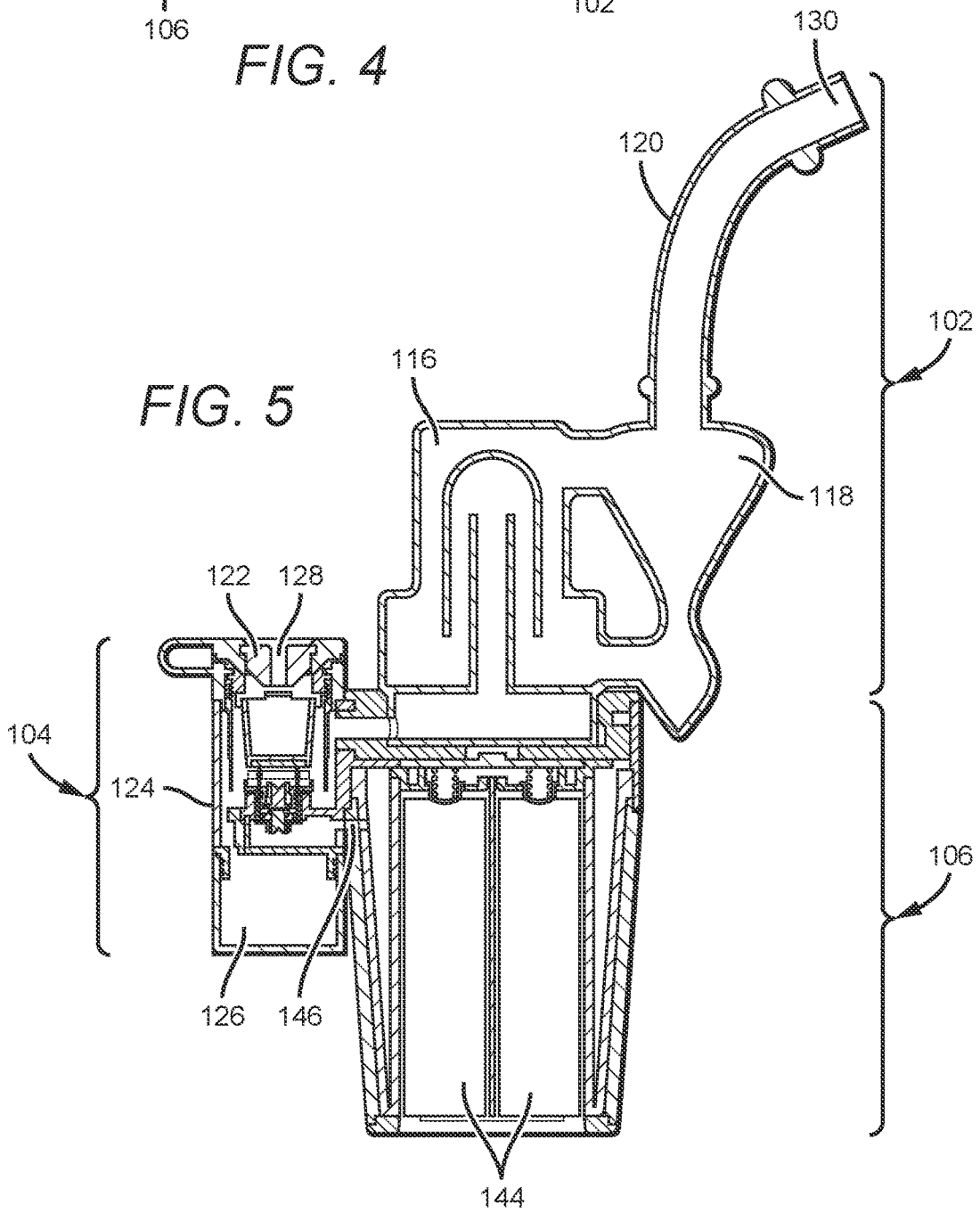
FIG. 5 shows the vaporization in a side, cutaway view.

FIG. 5 shows a side, cutaway view of device 100. From this view, internal aspects of vapor recycling portion 102, bowl portion 104, and main housing portion 106 are visible. Bowl portion 104 is configured to house, among other components, bowl 132 and heating element 134. Heating element 134 is coupled with a bottom portion of bowl 132 such that it can heat contents contained within bowl 132. Heating element 134 is connects to two electrical leads, a first lead 136 being incorporated into a male threaded portion and a second electrical lead 138 protruding downward. Upon screwing the parts together, first lead 136 contacts female threaded portion 140 and second electrical lead 138 contacts receiving lead 142. Receiving lead 142 and female threaded portion 140 couple with batteries 144 contained within main housing portion 106 via wires (not shown) that pass through wire pathway 146 into main housing portion 106.

Heating elements of the inventive subject matter are configured to bring any contents held within a bowl up to a temperature that is below a burning temperature, but hot enough to create vapor. Several example temperatures follow, and it should be understood that each disclosed temperature can vary by +/−15% without deviating from the inventive subject matter. Moreover, all temperatures disclosed in both Table A and Table B should be interpreted as disclosing endpoints for different temperature ranges. Table A shows vaporization temperatures for different terpenes.

TABLE A

| Chemical | Temperature |
|---|---|
| Caryophyllene oxide | 495° F./257° C. |
| Phytol | 399° F./204° C. |
| Humulene | 388° F./198° C. |
| Linalool | 365° F./185° C. |
| Terpinolene | 365° F./185° C. |
| Limonene | 437° F./225° C. |
| Citronellol | 437° F./225° C. |
| β-Myrcene | 334° F./168° C. |
| β-Caryophyllene | 320° F./165° C. |

And Table B shows vaporization temperatures for different cannabinoids.

TABLE B

| Chemical | Temperature |
|---|---|
| THC | 315° F./157° C. |
| THCa | 220° F./104° C. |
| THCv | 428° F./220° C. |
| CBD | 356° F./180° C. |
| CBDa | 248° F./120° C. |
| CBC | 428° F./220° C. |
| CBG | 126° F./52° C. |
| CBN | 365° F./185° C. |

Tables A and B thus disclose many different temperatures and, by extension, temperature ranges that embodiments of the inventive subject matter can be configured to operate at. Despite temperatures disclosed in Tables A and B, temperatures can be set to as low as 100° F. and as high as 650° F. A range of temperatures that can work well with vaporizing devices of the inventive subject matter spans from 350° F. to 650° F.

Figure 6:
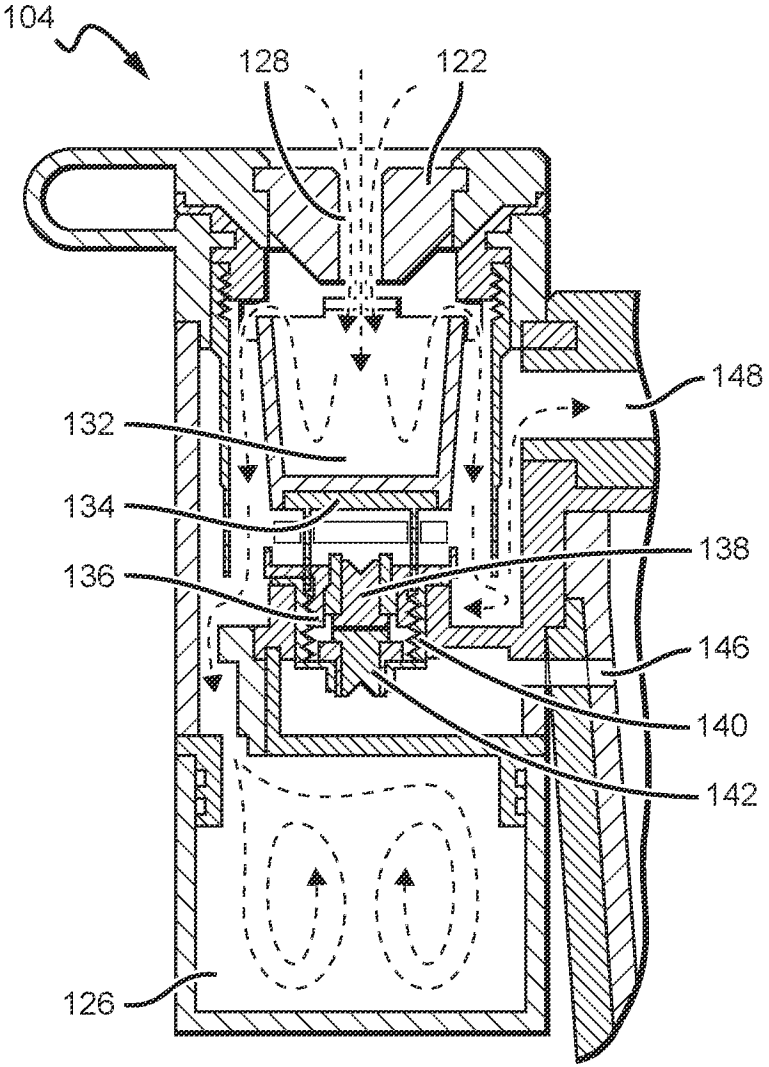
FIG. 6 shows bowl portion of the vaporization device from a side, cutaway view.

FIG. 6 shows how gas flows through bowl portion 104. When in use (e.g., when a user draws air into the device via mouthpiece hole 130), air is pulled through removable carb 122 via inlet 128. While air is drawn in, heating element 134 is activated to apply heat to bowl 132. A substance contained within bowl 132 is heated to create inhalable vapor, and that inhalable vapor is combined with the air to create an air/vapor mixture. Arrowed lines show how air passes into bowl portion 104, travels through bowl 132, and then is pulled down around the outside of bowl 132. From there, some amount of the air/vapor mixture passes into residue reservoir 126. Residue reservoir 126 acts as a reservoir for residue that condenses out of the air/vapor mixture. By creating an area for residue to condense and collect before passing through narrow passageways, device 100 is able to function properly for longer periods of time without needing to be cleaned or thrown away. Residue reservoir 126 can be removable, which allows it to be cleaned as needed. In some embodiments, it screws onto the other portions of bowl portion 104, while in others it can be pressure fit or clipped into bowl portion 104. Because device 100 is designed for gas flow, however residue reservoir 126 is attached to the other portions of bowl portion 104 it should be mostly or entirely gas tight.

Because residue reservoir 126 is positioned at a lowest point among all gas pathways, cooler, denser air/vapor mixture is more likely to pass through it, making the cooler, denser air/vapor mixture more likely to deposit sticky particulate matter and condensed residue within the residue reservoir 126. Moreover, residue reservoir 126 acts as a drip catch. Residue that accumulates on surfaces within device 100 can drip down to residue reservoir 126. Residue reservoir 126 can then be periodically emptied and cleaned out. Air/vapor mixture leaves bowl portion 104 via pathway 148.

Figure 7:
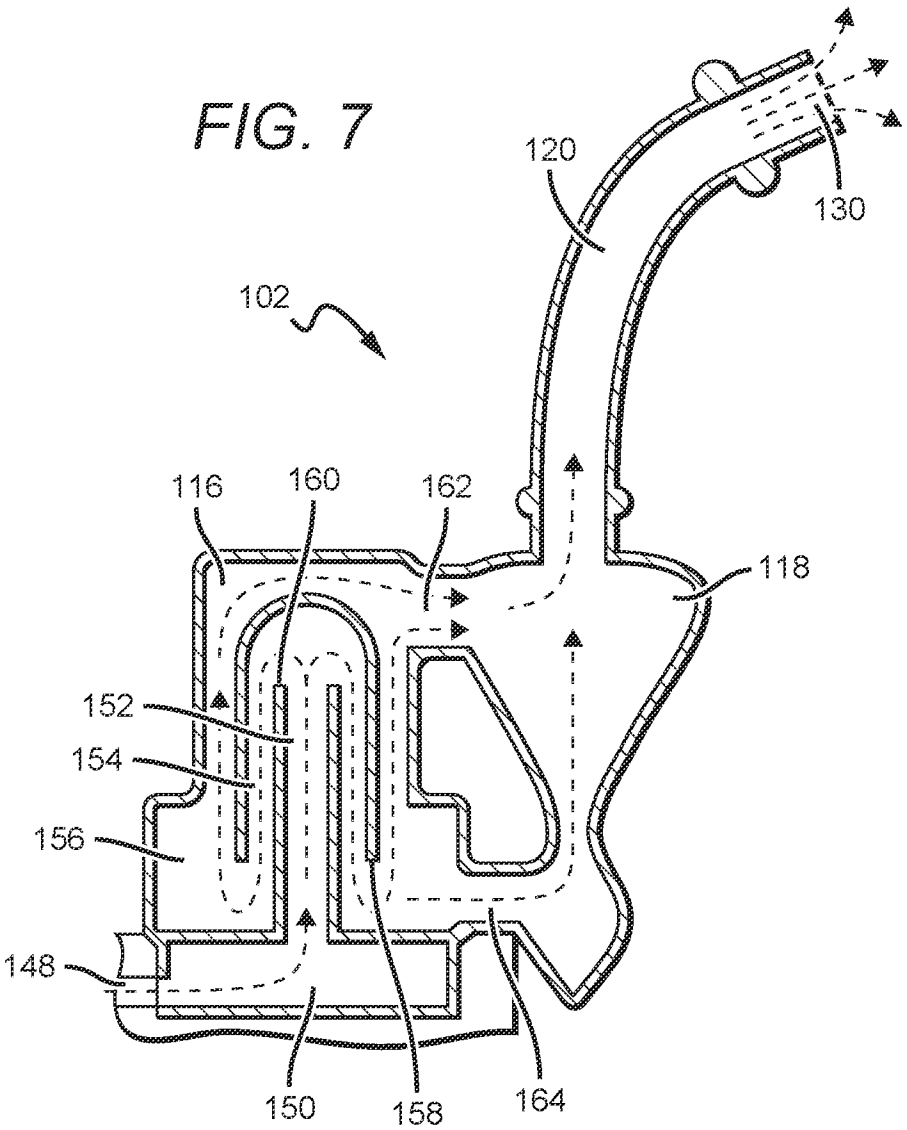
FIG. 7 shows vapor recycler portion from a side, cutaway view.

After leaving pathway 148, air/vapor mixture enters vapor mixture recycler portion 102, as shown in FIG. 7. Recycling portion 102 is designed to cool the air/vapor mixture prior to inhaling. In some embodiments, vapor mixture recycler portion 102 is made from glass, though other ceramics and metals can also be implemented. As air/vapor mixture enters vapor mixture recycler portion 102, it first enters bottom reservoir 150, which is part of first chamber 116. Bottom reservoir 150 can act as a first cooling chamber where air/vapor mixture can collect before moving to a subsequent area. Bottom reservoir 150 comprises an outlet for air/vapor mixture to leave from. This outlet is shown disposed on a top portion of bottom reservoir 150, though such an outlet can be disposed on any surface.

Air/vapor mixture then travels up through center vertical pathway 152 before being drawn back down through annular pathway 154. Annular pathway 154 is ring-shaped such that vertical pathway 152 passes through its center. As air/vapor mixture travels downward through annular pathway 154, it can then enters water reservoir 156. Water reservoir 156 is also annular and disposed around vertical pathway 152. Although device 100 can function without water in water reservoir 156, an appropriate water level would be above a bottom edge of annular pathway 158 and below a top edge of vertical pathway 160. Ideally, water does not get into bottom reservoir 150. Second chamber 118 is coupled with first chamber 116 by two pathways, a top pathway 162 and a bottom pathway 164. Because bottom pathway 164 is positioned below a water level (e.g., when water is used), second chamber 118 would fill partially with water. Thus, air/vapor mixture passing through first chamber 116 into second chamber 118 would have passed through bottom reservoir 150, vertical pathway 152, annular pathway 154, water reservoir 156 (and, thus, through water when water is present), before entering second chamber 118 and finally into stem 120 before exiting device 100 via mouthpiece hole 130.

Thus, specific vaporizing systems having residue reservoirs have been disclosed. It should be apparent, however, to those skilled in the art that many more modifications besides those already described are possible without departing from the inventive concepts in this application. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A vaporizing device comprising:

a bowl portion comprising a first gas flow pathway connecting a removable bowl to a removable residue reservoir, and an inlet;

wherein the removable bowl comprises a heating element coupled to a bottom portion of the removable bowl;

wherein the removable residue reservoir is disposed directly below the removable bowl and the inlet is disposed directly above the removable bowl;

wherein the bowl portion is connected to a vapor recycler portion by a second gas flow pathway such that the bowl portion is at least partially disposed beside the vapor recycler portion;

the vapor recycler portion comprising a first chamber and a second chamber;

wherein the first chamber comprises a bottom reservoir, a vertical gas pathway, and an annular gas pathway surrounding the vertical gas pathway;

wherein the second gas flow pathway connects the bowl portion to the bottom reservoir of the first chamber;

wherein the second chamber couples with the first chamber by a top gas pathway and a bottom gas pathway, and wherein a stem comprises a mouthpiece hole and extends from the second chamber;

wherein, when the user inhales via the mouthpiece hole, the heating element is activated and gas travels through an air/vapor mixture pathway comprising: the inlet, the first gas flow pathway, the removable residue reservoir, the second gas flow pathway, the bottom reservoir, the vertical gas pathway, the annular gas pathway, at least one of the top gas pathway and the bottom gas pathway, the second chamber, and the stem; and wherein the removable residue reservoir is positioned at a lowest point along the air/vapor mixture pathway.

2. The vaporizing device of claim 1, wherein the bowl portion further comprises a removable carb disposed above the removable bowl.

3. The vaporizing device of claim 1, wherein the heating element is configured to heat the removable bowl to between 350° F. to 650° F.

4. The vaporizing device of claim 1, wherein the heating element is configured to heat the bowl to between 126° F. to 650° F.

5. The vaporizing device of claim 1, further comprising a housing portion, the housing portion having an interior space for batteries and an exterior surface with a display, a charging port, and at least one input.

6. A vaporizing device, comprising:

a bowl portion comprising a bowl and an inlet;

a first gas flow pathway connecting a residue reservoir to the bowl, wherein the residue reservoir is disposed directly below the bowl;

wherein the residue reservoir is removable;

wherein the bowl portion is connected to a vapor recycler portion by a second gas flow pathway such that the bowl portion is at least partially disposed beside the vapor recycler portion;

the vapor recycler portion comprising a first chamber and a second chamber;

wherein the second gas flow pathway connects the bowl portion to the first chamber;

wherein the second chamber couples with the first chamber by a top gas pathway and a bottom gas pathway, and wherein a mouthpiece extends from the second chamber;

wherein, when the user inhales via the mouthpiece hole, a heating element is activated and gas travels through an air/vapor mixture pathway comprising: the inlet, the first gas flow pathway, the residue reservoir, the second gas flow pathway, the first chamber, at least one of the top gas pathway and the bottom gas pathway, the second chamber, and the mouthpiece; and wherein the residue reservoir is positioned at a lowest point along the air/vapor mixture pathway.

7. The vaporizing device of claim 6, wherein the first chamber comprises a bottom reservoir, a vertical gas, and an annular gas pathway surrounding the vertical gas pathway.

8. The vaporizing device of claim 6, wherein the first chamber and the second chamber are configured to hold water.

9. The vaporizing device of claim 6, wherein the bowl portion further comprises a removable carb disposed above the bowl.

10. The vaporizing device of claim 6, wherein the heating element is configured to heat the bowl to between 350° F. to 650° F.

11. The vaporizing device of claim 6, wherein the heating element is configured to heat the bowl to between 126° F. to 650° F.

* * * * *